US006372698B1

(12) United States Patent
Strothoff et al.

(10) Patent No.: US 6,372,698 B1
(45) Date of Patent: Apr. 16, 2002

(54) LUBRICANT FOR CHAIN CONVEYOR BELTS AND ITS USE

(75) Inventors: Werner Strothoff, Rheinfelden; Birgit Winkelmann, Krefeld, both of (DE)

(73) Assignee: Henkel-Ecolab GmbH & Co. OHG, Dusseldorf (DE)

( * ) Notice: Subject to any disclaimer, the term of this patent is extended or adjusted under 35 U.S.C. 154(b) by 0 days.

(21) Appl. No.: 08/295,754

(22) PCT Filed: Feb. 22, 1993

(86) PCT No.: PCT/EP93/00412

§ 371 Date: Sep. 1, 1994

§ 102(e) Date: Sep. 1, 1994

(87) PCT Pub. No.: WO93/18120

PCT Pub. Date: Sep. 16, 1993

(30) Foreign Application Priority Data

Mar. 2, 1992 (DE) ..... 42 06 505

(51) Int. Cl.[7] ..... C10M 129/26; C10M 133/06

(52) U.S. Cl. ..... 508/459; 508/465; 508/476; 508/500; 508/503

(58) Field of Search ..... 252/34, 41, 51, 252/49.3; 508/459, 465, 476, 500, 503

(56) References Cited

U.S. PATENT DOCUMENTS

| | | | | |
|---|---|---|---|---|
| 2,468,012 A | | 4/1949 | Isbell | 260/534 |
| 3,265,620 A | * | 8/1966 | Heiman | 252/52.8 R |
| 3,310,489 A | * | 3/1967 | Davis | 252/49.3 |
| 3,336,225 A | * | 8/1967 | Sayard et al. | 252/49.3 |
| 3,574,100 A | * | 4/1971 | Wetmore | 252/32.5 |
| 3,860,521 A | * | 1/1975 | Aepli et al. | 252/34.7 |
| 4,521,321 A | * | 6/1985 | Anderson et al. | 252/49.3 |
| 4,780,150 A | * | 10/1988 | Anderson et al. | 134/3 |
| 4,828,727 A | * | 5/1989 | McAninch et al. | 252/11 |
| 4,839,067 A | * | 6/1989 | Jansen | 252/11 |
| 4,929,375 A | * | 5/1990 | Rossio et al. | 252/49.3 |
| 5,062,979 A | * | 11/1991 | Scharf et al. | 252/49.3 |
| 5,182,035 A | * | 1/1993 | Schmidt et al. | 252/34 |
| 5,244,589 A | * | 9/1993 | Liu et al. | 252/49.3 |
| 5,352,376 A | * | 10/1994 | Gutzmann et al. | 252/49.3 |

FOREIGN PATENT DOCUMENTS

| | | |
|---|---|---|
| DE | 2313330 | 10/1973 |
| DE | 3631953 | 3/1988 |
| DE | 3831448 | 3/1990 |
| DE | 3905548 | 9/1990 |
| EP | 0044458 | 1/1982 |
| EP | 0372628 | 6/1990 |
| JP | 55102699 | 8/1980 |

* cited by examiner

*Primary Examiner*—Margaret Medley
(74) *Attorney, Agent, or Firm*—Andrew D. Sorensen; Ecolab Inc.

(57) ABSTRACT

Chain conveyor lubricants, especially for the food industry, which form clear solutions in water and which contain in combination a) at least one compound corresponding to formula (I):

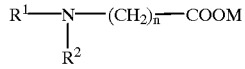

(I)

in which $R^1$ is a saturated or mono- or polyunsaturated, linear or branched alkyl group containing 6 to 22 carbon atoms, which may optionally be substituted by an —OH, —$NH_2$, —NH—, —CO—, halogen or a carboxyl group, $R^2$ is a carboxyl group containing 2 to 7 carbon atoms, M is hydrogen, alkali metal, ammonium, an alkyl group containing 1 to 4 carbon atoms or a benzyl group, and n is an integer of 1 to 6;

b) at least one organic carboxylic acid selected from monobasic or polybasic, saturated or mono- or polyunsaturated carboxylic acids containing 2 to 22 carbon atoms; and, optionally, c) at least one of water, additives, and auxiliaries.

16 Claims, No Drawings

LUBRICANT FOR CHAIN CONVEYOR BELTS AND ITS USE

BACKGROUND OF THE INVENTION

1. Field of the Invention

This invention relates to chain conveyor lubricants which form clear solutions in water and which contain amphoteric compounds corresponding to general formula (I), organic carboxylic acids and, optionally, water and additives and/or auxiliaries.

The invention also relates to the use of such lubricant combinations as chain conveyor lubricants in the food industry. More particularly, the lubricants according to the invention are used for lubricating, cleaning and disinfecting automatic chain conveyors of the type used in the packaging of foods, preferably beverages, in glass and plastic bottles, cans, glasses, barrels, kegs, paper and cardboard containers and the like.

2. Statement of Related Art

In bottle cellars and barrel cellars of beverage factories and in the packaging of foods, plate-type conveyor belts or chain conveyors are normally used for transporting the corresponding vessels, being lubricated and kept clean with suitable water-based lubricant preparations applied by dip lubrication or by automatic belt lubrication systems.

Whereas, in dip lubrication systems, the choice of the lubricant does not present any problems so far as performance properties are concerned, the precipitation of poorly soluble salts together with microbiological deposits in the nozzles and filters of centralized lubrication systems can seriously affect the continuous packaging of foods, particularly beverages, so that the systems always have to be switched off and cleaned after a certain period of operation.

The chain lubricants hitherto used for lubrication are based on the one hand on fatty acids in the form of their water-soluble alkali metal or alkanolamine salts or on fatty amines in the form of their organic or inorganic salts.

DE-A-23 13 330 describes soap-based lubricants containing aqueous mixtures of $C_{16-18}$ fatty acid salts and surfactants.

Apart from these soap-based lubricants, lubricants based on primary fatty amines are otherwise mainly used. Thus, DE-A-36 31 953 describes a process for lubricating chain-type bottle conveyors in bottling plants, more particularly in breweries, and for cleaning the conveyors with a liquid cleaner which is characterized in that the chain-type bottle conveyors are lubricated with conveyor lubricants based on neutralized primary fatty amines which preferably contain 12 to 18 carbon atoms and an unsaturated component of more than 10% and in that the bottle conveyors are cleaned with cationic cleaning preparations based on the quaternary ammonium compounds, such as alkyl trimethyl ammonium chloride, dialkyl dimethyl ammonium chloride and alkyl dimethyl benzyl ammonium chloride, or organic acids.

The main disadvantages of these fatty amines are: the reaction with anions present in the water, more particularly sulfates, bicarbonates, phosphates and carbonates from alkaline waters and other water ingredients; a strong reaction with carbonic acid dissolved in water to form poorly soluble ammonium carbonates, for example in the case of beverages containing carbon dioxide; solubilizers have to be used; the spraying and distribution system has to be cleaned at regular intervals; otherwise the system as a whole blocks up and thus becomes unusable.

In the case of lubricants based on primary fatty amines, continuous 24-hour operation is not possible. Where primary fatty amines are used as lubricants, the plants can only be operated with minimal flexibility; in many cases, this process cannot be applied at all because premixing tanks are often present in existing plants. The use of primary fatty amines and the two process steps which it entails—on the one hand lubrication, on the other hand cleaning—involves high capital investment on equipment. Finally, the use of primary amines and lower alkanecarboxylic acids (for example acetic acid), which are necessary for the cleaning step, is accompanied by serious odor emission.

Accordingly, the main disadvantages of the processes mentioned above lie on the one hand in the marked dependence on water of the soap-based lubricants and in the need for regular cleaning of the system where lubricants based on primary amines are used. The precipitations encountered in both known processes have to be removed at the same time. A simple acid/base reaction is used for this purpose. In the case of soap products based on fatty acids, alkaline cleaners containing complexing agents are used for this reaction; in the case of products based on primary fatty amines, organic or inorganic acids are used as technical equivalents to perform the cleaning function.

Finally, chain lubricants without any of the disadvantages mentioned above are known from the prior art. Thus, EP-A-0 044 458 describes lubricant preparations which are substantially free from fatty acid soaps and which in addition contain a carboxylated nonionic surfactant and an acyl sarcosinate. The pH value of these products is in the range from 7 to 11 and, accordingly, is preferably in the neutral to alkaline range.

Finally, DE-A-38 31 448 relates to water-containing, soapless lubricant preparations which form clear solutions in water, to a process for their production and to their use in particular as lubricants for the transport of glass bottles or polyethylene terephthalate bottles. The substantially neutral water-containing lubricant preparations (pH 6 to 8) contain alkyl benzenesulfonates, alkoxylated alkanol phosphates and alkanecarboxylic acids, optionally in addition to typical solubilizers, solvents, foam inhibitors and disinfectants.

Unfortunately, the two products described above are attended by the following three disadvantages:

1. They are microbiologically unfavorable because they create excellent growth conditions for micro-organisms.
2. In addition, they show minimal cleaning power.
3. Finally, their foaming behavior is difficult to control.

DE-A-39 05 548 describes lubricants containing at least one secondary and/or tertiary amine and/or salts of such amines. Unfortunately, these conveyor hygiene products have been found in practice to exhibit certain problems on account of the skin irritation observed in a few cases which was attributed to these products and on account of the formation of toxic secondary products in the event of careless handling (alkalization). On account of their poor wetting effect, these hydrophobic compounds can only be used in the optimal operational state of a conveyor lubrication system. The compounds are neutralized by organic impurities or acids, for example by the introduction of phosphate.

U.S. Pat. No. 3,574,100 describes lubricant compositions containing amphoteric compounds which are named in this document as N-fatty alkyl-β-aminopropionates and N-fatty alkyl-β-iminodipropionates.

However, where these compounds are used in lubricants, relative high friction coefficients are observed.

In addition, their ability to form clear solutions in water is inadequate for use in centralized lubrication systems in the food industry, more particularly permanently installed automatic systems.

DESCRIPTION OF THE INVENTION

Accordingly, the problem addressed by the present invention was to provide new improved lubricant preparations, more particularly chain conveyor lubricants forming clear solutions in water, which would not be attended by the disadvantages of the prior art. The lubricants according to the invention have a good coefficient of friction, i.e. an excellent lubricating effect, generate little foam and combine an excellent cleaning effect with high microbicidal activity.

The present invention relates to chain conveyor lubricants forming clear solutions in water and containing in combination a) at least one compound corresponding to general formula (I):

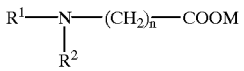

in which $R^1$ is a saturated or mono- or polyunsaturated, linear or branched alkyl group containing 6 to 22 carbon atoms which may optionally be substituted by —OH, —NH2, —NH—, —CO—, halogen or a carboxyl group, $R^2$ is a carboxyl group containing 2 to 7 carbon atoms, M is hydrogen, alkali metal, ammonium, an alkyl group containing 1 to 4 carbon atoms or a benzyl group and n is an integer of 1 to 6, b) at least one organic carboxylic acid selected from monobasic or polybasic, saturated or mono- or polyunsaturated carboxylic acids containing 2 to 22 carbon atoms, c) optionally water and additives and/or auxiliaries.

A chain conveyor lubricant with excellent properties is obtained through the combination of amphoteric surfactant and organic carboxylic acid. The lubricating effect with friction coefficients $\mu$ of 0.12 or lower is distinctly improved by comparison with amphoteric compounds on their own.

The in-use solution can be adjusted to a high pH value. The chain conveyor lubricants according to the invention are not dependent on water quality. In normal in-use concentrations, the lubricant combinations generate very little foam. Particularly favorable results were obtained in the evaluation of the emergency running properties. The ingredients are readily biodegradable and develop a good cleaning effect.

So far as their performance properties are concerned, the lubricant combinations according to the invention show a very high coefficient of friction, minimal foaming, a good cleaning effect and high compatibility with the skin. In addition to the positive properties mentioned, the following boundary conditions are satisfied: moderate foaming improves the lubricating effect in problem zones, such as rotary tables, changers, etc.; high substantivity and hence high lubricity, even under adverse operating conditions (for example underconveyor lubrication); low toxicity; generally usable despite inadequacies of equipment; good cleaning effect;

high capillary activity and film formation on surfaces;

effective, even in the presence of organic impurities and acids or alkalis, and non-corrosive, even in the form of a concentrate; unaffected by beverages.

When used in the beverage industry, the lubricant combinations according to the invention—in contrast to the chain lubricants hitherto used—are both independent of water quality and low-foaming, stable in storage at low temperatures, non-corrosive and particularly compatible with the environment and with the skin.

The compounds corresponding to general formula (I) to be used in accordance with the present invention may contain one of the following alkyl groups as the substituent $R^1$: hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl or docosyl. The corresponding mono- or polyunsaturated groups or the corresponding branched isomers are equally suitable. In addition, the above-mentioned groups may even be substituted by hydroxy, amino, imino, carbonyl, halogen (preferably chlorine atoms) or carboxyl groups. According to the invention, preferred compounds corresponding to general formula (I) are those which contain a linear, saturated or unsaturated alkyl group containing 8 to 18 carbon atoms and, more particularly, 10 to 18 carbon atoms as the substituent $R^1$.

In another preferred embodiment of the invention, the substituent $R^2$ in the general formula is the group $—(CH_2)_n—COOM$, where n and M are as defined above. In other words, the nitrogen atom of the fatty amine group is alkylated twice by identical groups.

The index "n" in general formula (I) is an integer of 1 to 6. Accordingly, the group mentioned is a methylene, ethylene, propylene, butylene, pentylene or hexylene group, and preferably the index "n" has a value of 2 or 3. Particular significance is attributed in this regard to the ethylene group (n=2). In another preferred embodiment of the invention, M is hydrogen or an alkali metal atom, preferred alkali metals being sodium or potassium, more particularly sodium.

Mixtures of compounds corresponding to general formula (I) may of course also be used in accordance with the invention. Examples of compounds corresponding to formula (I) suitable for use in accordance with the invention are sodium N-lauryl iminodipropionate, sodium N-cocosalkyl iminodipropionate or sodium N-oleyl iminodipropionate. These compounds may be prepared in accordance with U.S. Pat. No. 3,574,100. In addition, they are also commercially available, cf. for example DERIPHAT® 160C, a product of Henkel KGaA, Duesseldorf, Germany.

The choice of the organic carboxylic acid(s) is not critical providing clear solubility in water is guaranteed under the prevailing conditions. Accordingly, in one preferred embodiment of the present invention, the organic carboxylic acid is selected from acetic acid, citric acid and glycolic acid, particular significance being attributed to acetic acid.

Preferred chain conveyor lubricants contain 0.01 to 95% by weight of the compounds corresponding to general formula (I) and 5 to 50% by weight of the organic carboxylic acids. In this form, therefore, the chain conveyor lubricants may be obtained free from water. In one particularly preferred embodiment of the present invention, the chain conveyor lubricants contain 5 to 25% by weight of compounds corresponding to general formula (I) and 10 to 15% by weight of organic carboxylic acids. Besides water, the chain conveyor lubricants according to the invention may optionally contain other auxiliaries and/or additives as additional ingredients.

Suitable additives for the lubricant combinations according to the invention are primarily secondary and/or tertiary amines and/or salts of such amines as described in DE-A-39 05 548 cited above.

If desired, the lubricants according to the invention may also contain the N-fatty alkyl-β-aminopropionates described in U.S. Pat. No. 3,574,100 cited above. Reference is also made in this regard to EP-A-0 372 628 which likewise discloses corresponding N-alkyl aminocarboxylic acids, but in a broader form. Compounds such as these may also be used as additives in the lubricants according to the invention.

The additives in question, which may optionally be incorporated in the lubricants according to the invention, are generally used in quantities of 0 to 10% by weight and preferably in quantities of 1 to 5% by weight, based on the formulation as a whole.

In addition, the lubricant combinations according to the invention may contain as auxiliaries solubilizers for obtaining a homogeneous in-use solution with clear solubility in water. Examples of such solubilizers are alcohols, polyalcohols, ethers or polyethers, more particularly isopropanol, butyl glycol, butyl diglycol or ethylene glycol ether. The quantity of solubilizer to be used in each individual case is determined by the betaine used; in each individual case, the expert will determine the necessary quantity of solubilizer by trial and error. Additions of solubilizer of 1 to 20% by weight, based on the formulation as a whole, will generally be sufficient.

According to the invention, other suitable auxiliaries are anionic or nonionic surfactants, for example alkoxylated fatty amines, fatty alcohols, alkoxylated fatty alcohols and also alkyl benzenesulfonates soluble in hydrophilic solvents. These surfactants are capable of improving the wetting of the chains and plate-type conveyor belts should this be necessary in any individual case. In general, additions of surfactant of 1 to 10% by weight, based on the formulation as a whole, will be sufficient. Nonionic surfactants, preferably fatty alcohol/ethylene oxide or propylene oxide adducts, more particularly $C_{12/14}$ fatty alcohol 5EO/4PO adducts, are preferably used.

According to the invention, biocides may also be used as auxiliaries. The biocides used in accordance with the invention may be selected in particular from quaternary ammonium compounds (QUATS) which contain at least one long-chain alkyl group, more particularly with 8 to 16 carbon atoms, and/or at least one benzyl group optionally substituted by halogen atoms. Cocosalkyl dimethyl benzyl ammonium chloride (DODIGEN® 226, a product of Bayer AG) is mentioned as an example of such a biocide. In addition, compounds of the alkyl amino-ethylene glycine type containing an alkyl group with 6 to 22 carbon atoms and more particularly 10 to 16 carbon atoms and, preferably, two aminoethylene groups are mentioned as preferred biocides. Compounds of this type are also known as TEGO ampholytes and are marketed, for example, by Goldschmidt AG. (N-Dodecyl-bis-(aminoethylene))-N'-glycine (TEGO®51B, a product of Goldschmidt AG) is mentioned as an example of such a biocide. The biocides are generally added to the lubricants according to the invention in quantities of 0 to 10% by weight and more particularly in quantities of 1 to 5% by weight, based on the formulation as a whole.

If necessary, foam inhibitors may also be added to the lubricants according to the invention as further auxiliaries. Suitable foam inhibitors are, for example, addition products of ethylene oxide and propylene oxide with fatty alcohols and, in particular, end-capped fatty alcohol polyethylene glycol ethers.

The lubricant combinations according to the invention preferably have a pH value in the range from 3 to 6. If the pH value of the chain conveyor lubricant is not already in this range, it may be adjusted to the required value by addition of an acid, preferably an organic carboxylic acid, as defined above, for example with acetic acid.

In the interests of optimal dosing, the lubricant combinations have a dynamic viscosity of less than 300 mPa.s, preferably less than 150 mPa.s and more preferably in the range from 5 to 100 mpa.s, as measured at 20° C. There is generally no need for the viscosity to be separately adjusted to the values mentioned. If necessary, however, it may be adjusted to those values by addition of suitable quantities of the preferred diluent, water, or a solubilizer.

Where the lubricants according to the invention do not consist solely of compounds corresponding to general formula (I) and organic carboxylic acids, they may be prepared simply by mixing these components with water, optionally with addition of the additives and/or auxiliaries mentioned.

Finally, the present invention relates to the use of the chain conveyor lubricants described above as lubricants in the food industry, more particularly for automatic chain conveyor installations. For this application, the chain conveyor lubricants according to the invention are generally diluted with water. The resulting in-use solutions in water generally contain 0.01 to 1% by weight of compounds corresponding to general formula (I), preferably 0.01 to 0.2% by weight and more preferably 0.02 to 0.04% by weight of such compounds. The quantities of organic carboxylic acid to be used can be worked out from the quantity of compounds corresponding to general formula (I) simply by converting the quantities of concentrate.

In contrast to standard soap products, the products according to the invention do not cause any stress cracking and, accordingly, may readily be used for PET and PC containers (PET=polyethylene terephthalate, PC=polycarbonate) providing no surfactants which cause stress cracking in such materials are used as auxiliaries.

EXAMPLES

The invention is illustrated by the following Examples. Examples 1 to 9 according to the invention show formulations of lubricant concentrates and various performance data relating to the corresponding dilute aqueous in-use solutions, these solutions containing the respective concentrates in a quantity of 0.4% by weight. The performance data determined (coefficient of friction, foaming behavior, clear solubility in cold water and emergency running time) are explained in the following.

Examples 1 to 5 are Comparison Examples

In the following formulation examples, all percentages are by weight.

The tests for measuring resistance to friction (hereinafter referred to in short as the "friction coefficient") were carried out under the following conditions on a pilot-scale bottle conveyor:

- Measurement of the friction coefficient of 20×0.5 liter "Euro" beer bottles filled with water as tensile stress using a dynamometer.
- Speed of bottle conveyor: approx. 1 m/s
- Spraying of the bottle conveyor with 0.4% by weight conveyor lubricant solution as specified in the Examples.
- Spraying capacity of the nozzles: 4 l/h, one nozzle per conveyor.

The friction coefficient "$\mu$" shown in the following is the quotient of the measured tensile stress for a bottle to the weight of the bottle in grams.

In addition, the products were tested with hard water (16° d) in accordance with the provisions of DIN 53 902.

Foaming behavior is classified as follows:

0=foam-free

1=occasional foam bubbles

2=slight foaming, not troublesome

3=foaming, troublesome

4=intensive foaming, unacceptable, foam under the conveyor

For adequate lubrication, the friction coefficient should be less than 0.15. If it exceeds 0.15, there is a significant deterioration in the lubricating effect and hence in satisfactory transport.

The clear solubility in water of the in-use solutions should be guaranteed even over prolonged test periods in order to avoid deposits in ball valve filters, nozzles, the spraying and distribution system, the conveyor and the articles being conveyed. A 0.4% by weight solution in water with a hardness of 16° d was stored for 72 h and then visually evaluated.

Foaming should be minimal because excessive foam not only affects the automatic bottle inspector and factory safety (danger of slipping), it can also soften labels and enter the as yet uncapped containers. In addition, the friction coefficient is adversely affected by excessive foaming. By contrast, low foaming is of advantage because it ensures better distribution of the lubricant on the conveyor belts.

Under the test conditions which were also used to determine friction coefficient and foaming behavior, the dosing of the chain conveyor lubricant was stopped after a running time of 30 minutes. From this moment on, the bottles are only lubricated by adhering chain conveyor lubricant. The period of time for which lubrication was maintained with no significant deterioration in the friction coefficient was measured. The end of the test (emergency running time) is reached when the friction coefficient has fallen by 20% from the starting value.

Example 1

15% Sodium N-lauryl iminodipropionate
14% Acetic acid
71% Water
Friction coefficient: $\mu$=0.10, foaming=2
Clear solubility in water: substantially clear
Emergency running time: 20 mins.

Example 2

15% Sodium N-lauryl iminodipropionate
14% Acetic acid
68% Water
3% $C_{12-14}$ fatty alcohol ·5 EO/4PO
Friction coefficient: $\mu$=0.10, foaming=1
Clear solubility in water: absolutely clear
Emergency running time: 25 mins.

Example 3

15% Sodium N-lauryl iminodipropionate
13% Citric acid
72% Water
Friction coefficient: $\mu$=0.11, foaming=2
Clear solubility in water: substantially clear
Emergency running time: 15 mins.

Example 4

15% Sodium N-lauryl iminodipropionate
10% Glycolic acid
75% Water
Friction coefficient: $\mu$=0.11, foaming=1
Clear solubility in water: substantially clear
Emergency running time: not tested Example 5

86% Sodium N-lauryl iminodipropionate
14% Acetic acid
Friction coefficient: $\mu$=0.10, foaming=1
Clear solubility in water: substantially clear
Emergency running time: 20 mins.

Example 6

15% Sodium N-lauryl iminodipropionate
14% Acetic acid
68% Water
3% Cocosalkyl dimethyl benzylammonium chloride
Friction coefficient: $\mu$=0.10, foaming=1
Clear solubility in water: absolutely clear
Emergency running time: 25 mins.

Example 7

15% Sodium N-lauryl iminodipropionate
14% Acetic acid
68% Water
3% (N-dodecyl-bis-(aminoethylene))-N'-glycine
Friction coefficient: $\mu$=0.10, foaming=1
Clear solubility in water: absolutely clear
Emergency running time: 20 mins.

Example 8

15% Sodium N-cocosiminodipropionate
14% Acetic acid
68% Water
3% Cocosdimethyl benzylammonium chloride
Friction coefficient: $\mu$=0.12, foaming=0
Clear solubility in water: absolutely clear
Emergency running time: 20 mins.

Example 9

15% Sodium N-cocosiminodipropionate
1% Sodium N-oleyl iminodipropionate
14% Acetic acid
68% Water
3% Cocosdimethyl benzylammonium chloride
Friction coefficient: $\mu$=0.11, foaming=0
Clear solubility in water: absolutely clear
Emergency running time: 20 mins.

Comparison Example 1

(Soap-containing chain lubricant)
59% Water
10% Butyl diglycol
15% Fatty acid (oleic/linoleic)
9% Ethylenediamine tetraacetate Na4
4% Monoethanolamine 3% Potassium hydroxide Friction coefficient: $\mu$=0.12, foaming: 3–4

Clear solubility in water: forms a clear solution in water in a concentration of 1% up to 12.5° d Emergency running time: 5 mins.

Comparison Example 2

(Alkylamine-based chain lubricant)

4% N,N-Dimethyl-N-lauryl ammonium acetate

8% Lauryl propylene diammonium acetate

88% Water

Friction coefficient: $\mu$=0.10, foaming=1

Clear solubility: opaque

Emergency running time: approx. 7 mins.

Comparison Example 3

(U.S. Pat. No. 3,574,100)

15% N-Cocosalkyl aminopropionic acid

85% Water

Friction coefficient: $\mu$=0.14, foaming behavior=2

Clear solubility: opaque

Emergency running time: 10 mins.

Comparison Example 4

(U.S. Pat. No. 3,574,100)

15% N-Cocosalkyl aminopropionic acid

3% Lauryl ether phosphoric acid ester

82% Water

Friction coefficient: $\mu$=0.13, foaming=4

Clear solubility in water: opaque

Emergency running time: 7 mins.

Comparison Example 5

15% Sodium-N-lauryl iminodipropionate

85% Water

Friction coefficient: 0.12, foaming=2

Clear solubility in water: opaque

Emergency running time: 15 mins.

What is claimed is:

1. A water-free conveyor lubricant which forms clear solutions in water consisting of:

a) from 0.01 to 95% by weight of at least one compound corresponding to formula (I):

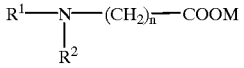

in which $R^1$ is a saturated or mono- or polyunsaturated, linear or branched alkyl group containing 6 to 22 carbon atoms, which may optionally be substituted by an —OH, —$NH_2$, —NH—, —CO—, halogen or a carboxyl group, $R^2$ is a carboxyl group containing 2 to 7 carbon atoms, M is hydrogen, alkali metal, ammonium, an alkyl group containing 1 to 4 carbon atoms or a benzyl group, and n is an integer of 1 to 6;

b) from 5 to 50% by weight of at least one organic carboxylic acid selected from monobasic or polybasic, saturated or mono- or polyunsaturated carboxylic acids containing 2 to 22 carbon atoms;

c) at least one solubilizer selected from the group consisting of alcohols, polyalcohols, ethers, and polyethers;

d) a nonionic surfactant or an anionic surfactant;

e) a biocide selected from the group consisting of a quaternary ammonium compound and/or an alkyl aminoethylene glycine; and f) a foam inhibitor.

2. The lubricant of claim 1 wherein in formula I the $R^2$ group is the group —$(CH_2)_n$—COOM in which n and m are as defined therein.

3. The lubricant of claim 1 wherein in formula I, n=2 or 3.

4. The lubricant of claim 2 wherein in formula I the n integers are both either 2 or 3.

5. The lubricant of claim 1 wherein in formula I, n=2.

6. The lubricant of claim 1 wherein in formula I, $R^1$ is a linear, saturated or unsaturated alkyl group containing 8 to 18 carbon atoms.

7. The lubricant of claim 6 wherein $R^1$ contains 10 to 18 carbon atoms.

8. The lubricant of claim 1 wherein component b) is at least one acid selected from the group consisting of acetic acid, citric acid and glycolic acid.

9. The lubricant of claim 1 wherein component b) is acetic acid.

10. A method for lubricating a chain used in the food and beverage industry comprising applying to said chain a lubricating quantity of an aqueous solution of a chain lubricant consisting of:

a) 0.01% to 1% by weight of at least one compound corresponding to formula (I):

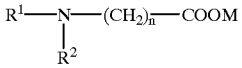

in which $R^1$ is a saturated or mono- or polyunsaturated, linear or branched alkyl group containing 6 to 22 carbon atoms, which may optionally be substituted by an —OH, —$NH_2$, —NH—, —CO—, halogen or a carboxyl group, $R^2$ is a carboxyl group containing 2 to 7 carbon atoms, M is hydrogen, alkali metal, ammonium, an alkyl group containing 1 to 4 carbon atoms or a benzyl group, and n is an integer of 1 to 6;

b) at least one organic carboxylic acid selected from monobasic or polybasic, saturated or mono- or polyunsaturated carboxylic acids containing 2 to 22 carbon atoms;

c) at least one solubilizer selected from the group consisting of alcohols, polyalcohols, ethers, and polyethers;

d) a nonionic surfactant or an anionic surfactant;

e) a biocide selected from the group consisting of a quaternary ammonium compound and/or an alkyl aminoethylene glycine; and f) a foam inhibitor.

11. The method of claim 10 wherein the lubricant is applied to an automatic chain conveyor.

12. The method of claim 10 wherein in the compound of formula I the $R^2$group is the group —$(CH_2)_n$—COOM in which n and M are as defined therein.

13. The method of claim 10 wherein in the compound of formula I, n=2 or 3.

14. The method of claim 10 wherein in formula I the n integers are both either 2 or 3.

15. The method of claim 10 wherein in the compound of formula I, $R^1$ is a linear, saturated or unsaturated alkyl group containing 8 to 18 carbon atoms.

16. The method of claim 10 wherein in the chain lubricant, component b) is at least one acid selected from the group consisting of acetic acid, citric acid and glycolic acid.

* * * * *